United States Patent [19]

Walus et al.

[11] 3,942,687

[45] Mar. 9, 1976

[54] APPLICATOR FOR MOLTEN THERMOPLASTIC ADHESIVES

[75] Inventors: Richard L. Walus, Minneapolis; Vernon K. Quarve, Brooklyn Center, both of Minn.

[73] Assignee: Possis Corporation, Minneapolis, Minn.

[22] Filed: Oct. 2, 1974

[21] Appl. No.: 511,351

[52] U.S. Cl. ..... 222/146 HE; 222/334; 222/380

[51] Int. Cl.[2] ..... B67D 5/46

[58] Field of Search ..... 222/146 HE, 309, 372, 375, 222/377, 378, 380, 334; 417/569, 570; 137/539

[56] References Cited

UNITED STATES PATENTS

| | | | |
|---|---|---|---|
| 1,563,545 | 12/1925 | Blakeslee | 137/539 |
| 2,684,806 | 7/1954 | McBean | 222/309 X |
| 2,689,075 | 9/1954 | Morton et al. | 222/380 X |
| 2,778,530 | 1/1957 | Sillars | 222/333 X |
| 2,831,214 | 4/1958 | Eyles et al. | 222/146 HE X |
| 3,149,753 | 9/1964 | Forsyth | 222/380 X |
| 3,764,045 | 10/1973 | Ornsteen | 222/146 HE |
| 3,768,102 | 10/1973 | Kwan-Gett et al. | 539 X/ |
| 3,826,224 | 7/1974 | Baker et al. | 222/334 X |
| 3,828,986 | 8/1974 | Roth | 222/380 |

FOREIGN PATENTS OR APPLICATIONS

| | | | |
|---|---|---|---|
| 1,143,152 | 2/1966 | United Kingdom | 222/380 |

*Primary Examiner*—Robert B. Reeves
*Assistant Examiner*—Charles A. Marmor

[57] ABSTRACT

An applicator by which small, discrete, uniform quantities of molten thermoplastic adhesive can be dispensed in rapid succession comprises a body having a heated inlet chamber, which hot melt enters under low pressure, and a pump chamber. A plunger in the pump chamber is reciprocated by a pneumatic motor. A charging stroke of the plunger draws hot melt out of the inlet chamber, across a check valve and into the pump chamber. The discharging stroke expels the hot melt across an outlet check valve and through an outlet orifice coaxial with the pump chamber.

11 Claims, 6 Drawing Figures

APPLICATOR FOR MOLTEN THERMOPLASTIC ADHESIVES

This invention relates to applicators for molten thermoplastic adhesives, and is more particularly concerned with an applicator by which small, discrete quantities of adhesive hot melt can be dispensed in rapid succession, so that a row of dots of such adhesive can be quickly and accurately deposited onto a workpiece surface.

Molten thermoplastic adhesives are widely used as bonding agents for paper, cardboard and other sheet materials. Commercially, such adhesives are obtainable in any of numerous formulations and are sold in the form of rods, pellets or the like. When the adhesive is to be used, it is heated to its molten state in a melting unit that comprises a reservoir for holding a supply of the molten material. A duct or hose carries the hot melt from the reservoir to an applicator by which the hot melt is deposited onto a workpiece surface where it is needed.

The present invention is concerned with a hot melt applicator which is in the nature of a nozzle or gun and which dispenses the adhesive intermittently, at regular and frequent intervals and in small, discrete, uniform quantities, so that relative motion between the gun and a workpiece beneath it causes the hot melt to be deposited on the workpiece as a row of dots. Hence the hot melt applicator of this invention can be designated a "dot gun."

A dot gun is particularly useful for packaging operations that are performed at more or less irregular intervals. For example, hot melt apparatus comprising a hand-held dot gun may be used in a shipping room, for applying hot melt to the closure flaps of shipping cartons whenever occasion arises. In such an installation the dot gun may be idle for a period of time between successive uses. However, a dot gun is also useful for many hot melt application processes that are more or less continuous in nature, and there are situations in which such an applicator is required to operate uninterruptedly for hours. In either type of installation the dot gun must dispense accurately uniform quantities of hot melt so that all of the dots that it forms will be equal in size and volume.

A prior dot gun hot melt applicator is disclosed in U.S. Pat. No. 3,408,008, to H.E. Cocks. The dot gun of that patent was essentially a valved nozzle, intended to be connected with a pressurized hot melt source by means of a flexible hose. Electric heating elements along the hose and at the nozzle assured that the thermoplastic would remain in its molten state and would issue from the nozzle at a temperature substantially higher than the temperature at which the adhesive solidified, so that after deposition there would be an adequately long cooling period during which the deposited adhesive remained tacky.

The Cocks patent points out that a valved nozzle dot gun cannot eject dots which are uniform as to volume unless ejection always begins promptly upon opening of the valve. It also recognizes that because of the high viscosity of most hot melt materials and the relatively small diameter of a dot gun nozzle, the hot melt will be sluggish in leaving the nozzle if its pressure there is not fairly high.

With prior valved nozzle dot guns of the type exemplified by Cocks, high pressure on hot melt at the nozzle required that the hot melt be under high pressure at the melting unit and all through the hose that connected the dot gun with the melting unit, even though the high pressure was actually needed only upon the very small volume of the fluid that was in the nozzle itself and just upstream from it. It seems unlikely that persons skilled in the art could have failed to recognize that this arrangement presented a serious potential hazard if the hose was not so designed and maintained as to afford absolute assurance that it would withstand high pressures notwithstanding the flexing to which it was subjected. Apparently the hazard was accepted as inevitable because no alternative was available to those skilled in the art.

The Cocks patent points out another disadvantage of prior valved nozzle dot guns. When pressure in the system was high enough to assure prompt issuance of the hot melt from the nozzle under most conditions, there would be occasions where the initial release of pressure would cause a greater thickness of the adhesive at the beginning point of application. The Cocks patent does not explain the cause of this initial surge of hot melt at the beginning of an ejection sequence. Undoubtedly, however, it was related to the fact that during a period of valve closure there would be a build-up of pressure all along the length of the flexible hose that connected the dot gun with the source of pressurized hot melt, and this pressure was abruptly relieved by expulsion of hot melt when the nozzle valve was opened and the flexible hose was allowed to relax. An oversize dot of hot melt at the beginning point of an application retained more heat then the normal size dots, therefore solidified more slowly, and thus gave rise to difficulties in the processing in which the applicator was used, or caused defects in the products produced by the processing.

The solution of this problem that was proposed by Cocks was to insert, near the nozzle outlet orifice, a pressure baffle that set up a primary reduction in pressure of the hot melt just before it issued from the nozzle, to retard the surge of adhesive that developed when the valve first opened. Obviously this solution did not get to the root cause of the problem. Furthermore, it involved a paradoxical inefficiency, inasmuch as the high pressure that was maintained all along the line for the purpose of forcing hot melt out of the nozzle was reduced precisely at the point where it was intended to be utilized.

The Cocks patent is mainly concerned with getting prompt but controlled emission of hot melt upon opening of the nozzle valve, and merely mentions that there must also be prompt cessation of flow of hot melt out of the nozzle when the valve closes. This other half of the general problem of achieving precise control of the quantity of hot melt issued at each ejection is given more attention in U.S. Pat. No. 3,386,625, to R. B. Lessard. To prevent drooling from the nozzle. The Lessard patent discloses means for producing a suction inside the applicator body by which a small amount of the hot melt in the nozzle outlet passage is positively drawn back into the body upon closure of the valve.

By contrast with the prior art, the general object of the present invention is to provide a dot gun that affords very accurate control of the quantity of hot melt issued from the gun nozzle at each ejection, and which does not require high pressure to be imposed upon the hot melt at a point upstream from the dot gun.

Hence, it is a more specific object of this invention to provide a dot gun which can be connected with a source of hot melt by means of a flexible hose that need not be capable of supporting particularly high pressures, thus affording an installation which has inherently greater overall safety than equivalent apparatus previously available.

As is evident from the foregoing discussion of the prior art, the usual expedient heretofore employed for metering the quantity of fluid expelled from a dot gun at each hot melt ejection has been, basically, to valve hot melt from a pressurized source thereof. If the valve was kept open for uniform periods, then during each such period a predetermined quantity of fluid would be expelled from the gun — provided the viscosity and pressure of the hot melt did not change between one such valveopen period and another. But the viscosity of the hot melt does in fact vary with time and circumstances; and from the foregoing discussion of the Cocks patent it is apparent that pressure on hot melt at a dot gun nozzle is not likely to remain constant if the source of such pressure is many feet distant from the nozzle, at the other end of a flexible hose.

Thus another and very important general object of this invention is to provide a dot gun which incorporates metering means whereby a precisely measured quantity of hot melt is drawn from a nearby supply thereof immediately prior to being ejected, and whereby the measured quantity thus drawn off is isolated from the remainder of the hot melt during its ejection, to thus ensure that precisely uniform quantities of hot melt will be consistently ejected regardless of the viscosity of the fluid or the pressure at the source thereof.

It is also an object of the invention to provide a dot gun of the character described wherein high pressure for expulsion of hot melt from the outlet nozzle of the gun is applied only to a metered and isolated quantity of hot melt that is to be expelled to form one dot, and only during the time that said quantity of hot melt is actually being expelled.

Another and more specific object of the present invention is to provide a dot gun that has readily adjustable means for controlling the quantity of hot melt to be expelled at each ejection.

A further object of the invention is to provide a compact and efficient dot gun that is capable of use with hot melt adhesives of any of a wide variety of formulations.

With these observations and objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

The accompanying drawings illustrate one complete example of an embodiment of the invention constructed according to the best mode so far devised for the practical application of the principles thereof, and in which.

Figure 1:
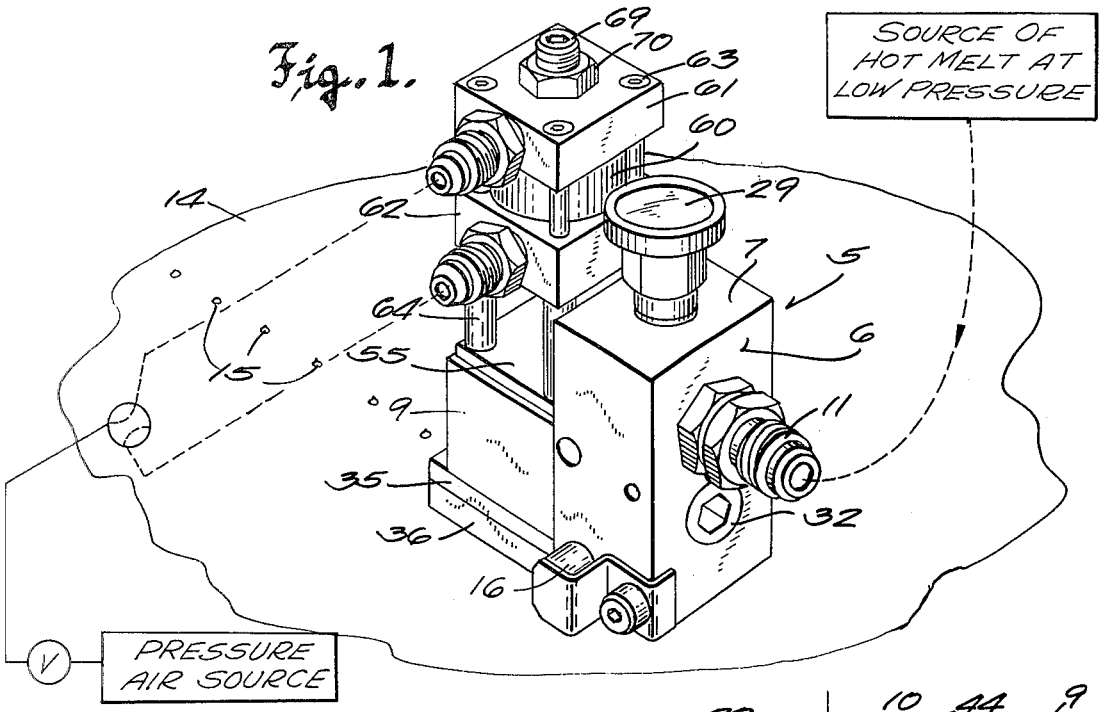
FIG. 1 is a side perspective view of a hot melt applicator or dot gun embodying the principles of this invention, illustrated in relation to a workpiece upon which it has deposited a row of dots of adhesive hot melt but, for simplicity, shown disconnected from a source of hot melt with which it cooperates.
Figure 3:
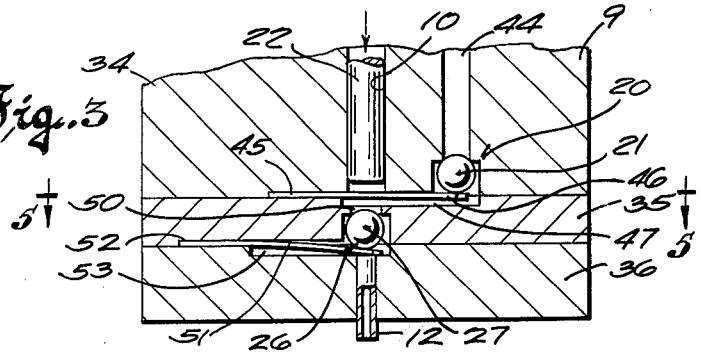
FIG. 3 is a fragmentary vertical sectional view generally corresponding to the lower portion of FIG. 2 but on an enlarged scale, particularly illustrating the positions of the check valves during the discharge stroke of the pump.
Figure 2:
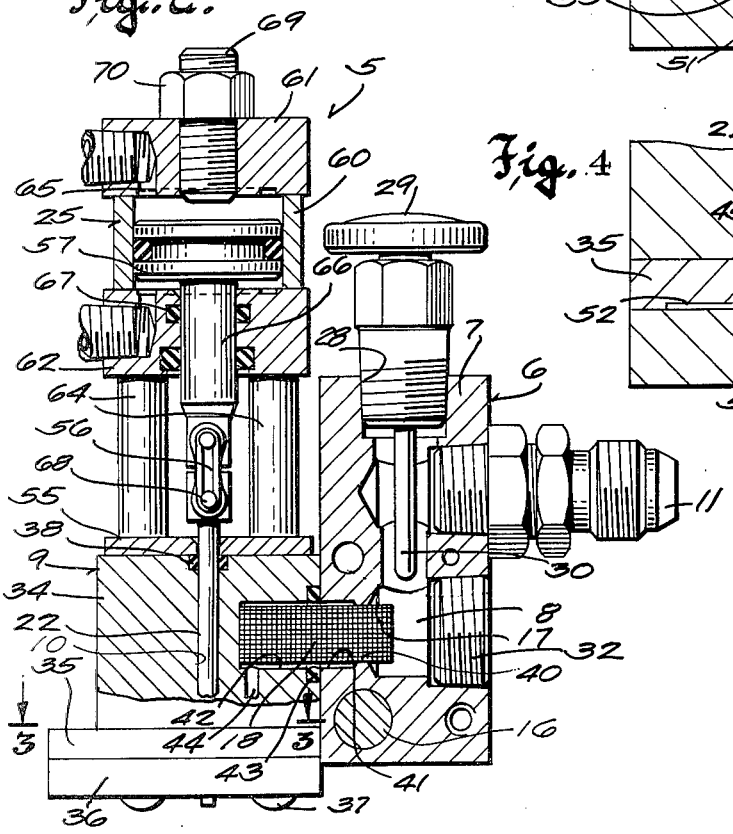
FIG. 2 is a view in vertical section of the hot melt applicator shown in FIG. 1, although the air cylinder of the applicator is shown rotated 90° around its axis as between FIG. 1 and FIG. 2, to simplify illustration of its porting.
Figure 4:
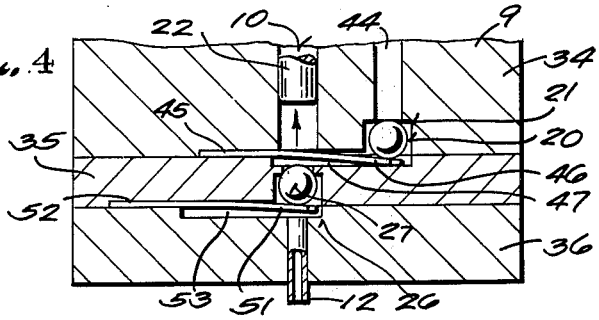
FIG. 4 is a view generally similar to FIG. 3 but illustrating the positions of the check valves during the charging stroke of the pump.
Figure 5:
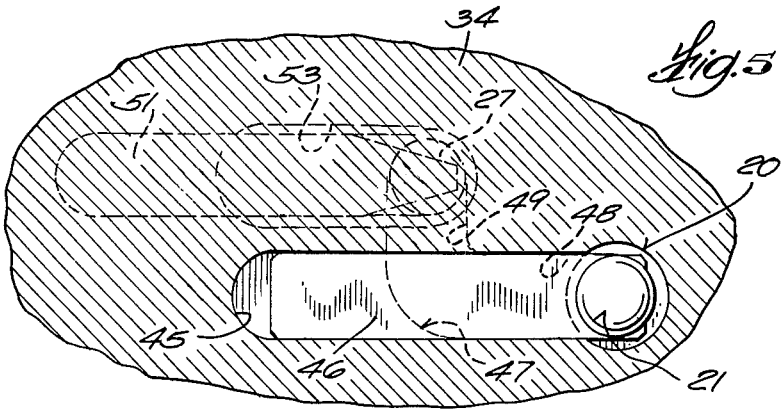
FIG. 5 is a fragmentary sectional view on a further enlarged scale taken on the plane of the line 5—5 in FIG. 3.
Figure 6:
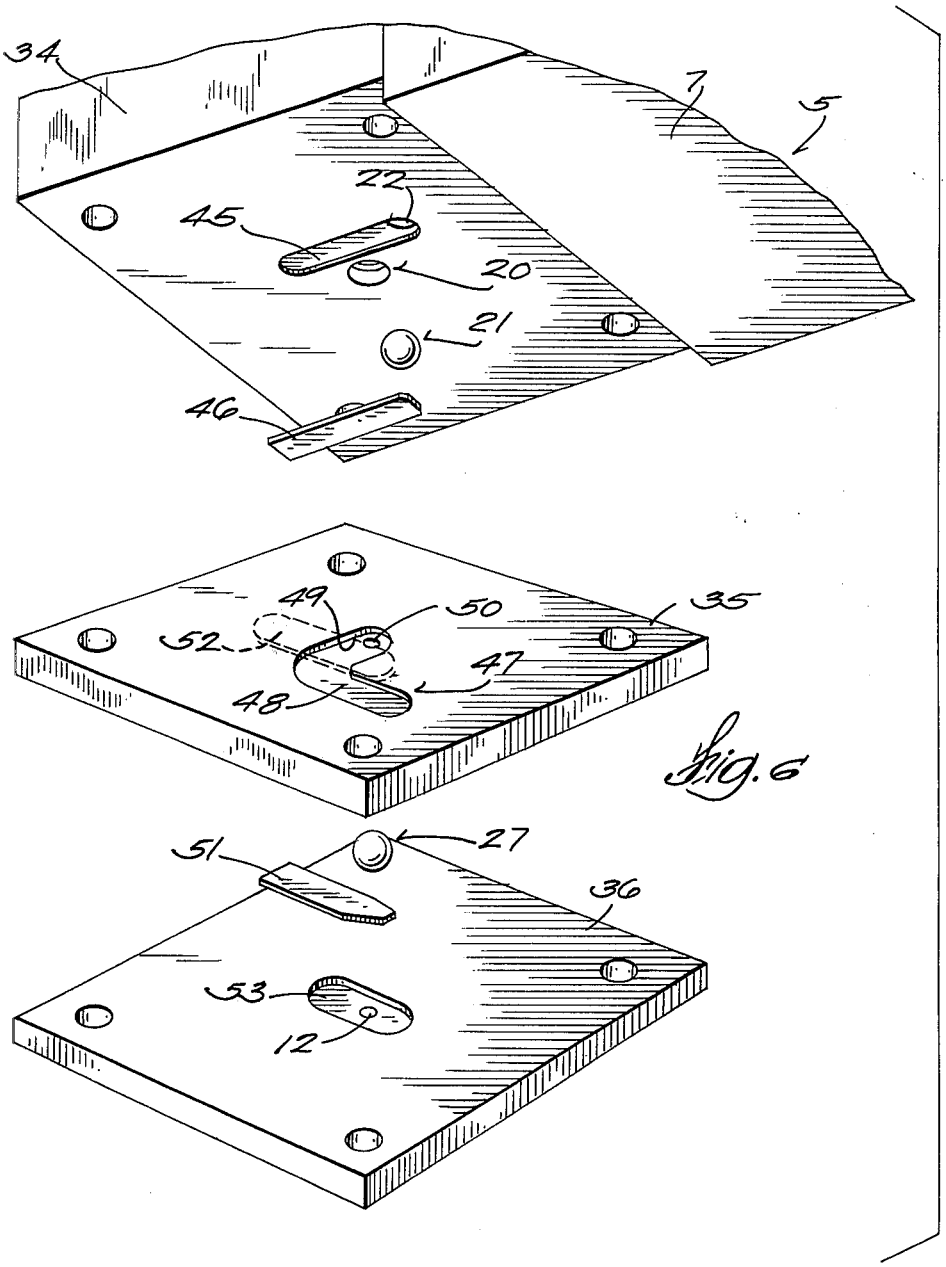
FIG. 6 is a disassembled perspective view of those portions of the applicator body that comprise its valve chambers and outlet.

Referring now more particularly to the accompanying drawings, the numeral 5 designates generally a dot gun hot melt applicator which embodies the principles of this invention and which is adapted to be connected with a source of molten thermoplastic adhesive. In contrast to prior dot gun applicators, to which hot melt had to be delivered under substantially high pressure, the applicator of this invention can be connected with a hot melt source at which pressure is no higher than is necessary merely to ensure a steady flow of hot melt to the applicator.

The applicator 5 has a generally L-shaped body 6 with an upright leg portion 7 that comprises an inlet chamber or compartment 8 and a forwardly projecting leg portion 9 that comprises a pump chamber 10. Hot melt enters the inlet chamber 8 through a fluid inlet fitting 11 in the rear of the upright leg portion of the body and is ejected from the applicator through a small diameter outlet orifice 12 at the underside of the front leg portion 9. The inlet fitting 11 is of course connectable with a hose or the like (not shown) that communicates the dot gun with a melting unit.

It will be appreciated that the body 6 of the applicator can be readily mounted on a machine in any suitable manner, for cooperation with other parts of the machine in the performance of a packaging or similar operation, or it can be equipped with a suitable handle so that it can be used as a self-contained hand held unit that is manually guided across a workpiece upon which dots of hot melt are to be deposited. In either case, the applicator, when in operation, ejects small, discrete quantities of hot melt from its outlet orifice 12 at regular intervals; hence relative linear motion between the applicator and a workpiece surface 14 beneath it will result in the deposition upon that surface of a row of uniform dots 15 of adhesive material.

The inlet chamber 8 in the upright leg portion 7 of the body, which is vertically elongated, serves as a small secondary reservoir for hot melt. Normally the adhesive is brought to the dot gun at a temperature somewhat below that at which it should be dispensed, and the necessary additional heat is imparted to it in the inlet chamber by means of an electric heating element 16 that is embedded in the lower portion of the upright leg.

Hot melt flows from the inlet chamber 8 towards the pump chamber 10 through a passage 17 which opens forwardly from the lower portion of the inlet chamber and in which there is a cylindrical filter screen 18 that prevents passage beyond the inlet chamber of any unmelted particles of adhesive material and any solid foreign matter.

In flowing from the screened passage 17 into the pump chamber, the molten adhesive must pass through an inlet valve chamber 20 in which there is an inlet check valve 21. That check valve is arranged to permit flow of fluid in the direction toward the pump chamber, but to block reverse flow, in the direction from the pump chamber towards the inlet chamber.

The pump chamber 10 is essentially a cylinder which is communicated at its lower end, which constitutes the mouth of the cylinder, (as explained below) with the inlet valve chamber 20. A closely fitting plunger 22 is axially reciprocable in the pump chamber and is driven for reciprocation by means of a penumatic motor 25 which is mounted on top of the forwardly projecting leg portion 9 of the applicator body.

Upward motion of the plunger 22 in the pump chamber constitutes a charging stroke by which a measured quantity of hot melt is drawn into the pump chamber from the inlet chamber 8. Downward motion of the plunger constitutes a discharging stroke by which that quantity of fluid is expelled through the nozzle orifice 12. The inlet check valve 21 is open during the charging stroke of the plunger and closed during its discharging stroke.

The nozzle orifice 12 is beneath the pump chamber and coaxial with it. Between the lower end of the pump chamber and the inner end of the orifice there is an outlet valve chamber 26 in which there is an outlet check valve 27. The outlet check valve is of course closed during the charging stroke of the plunger 22 and open during its discharging stroke.

It will be apparent that the reciprocating pump which comprises the plunger 22 and the check valves 21 and 27 applies pressure to hot melt precisely at the zone where pressure is needed — namely, at the inner end of the outlet orifice 12 — but only at the zone. Consequently that pump can safely and reliably apply a sufficiently high pressure to the hot melt to ensure its prompt and complete expulsion from the nozzle regardless of whether the hot melt is relatively viscous or relatively free flowing. It will also be apparent that the volumetric displacement of this reciprocating pump defines and accurately controls the quantity of hot melt that will be expelled from the nozzle at each ejection. Attention is also directed to the fact that the course of flow of hot melt through the applicator body takes it through relatively large diameter passages all the way from the inlet fitting 11 to near the inlet check valve 21, so that relatively little pressure is required to move the hot melt to that point. From the inner end of the screened passage 17 to the outer end of the outlet orifice the pump is responsible for flow of the hot melt, independently of any pressure at the hot melt source.

Turning now to a more detailed consideration of the structure of the dot gun, the upright leg portion 7 of the body can comprise a single rectangular block in which there is a lengthwise bored well that defines the inlet chamber 8. The inlet chamber well opens to the top of the block through a threaded counterbore 28 in which the correspondingly threaded body of a thermometer 29 is received. The thermometer, which has its sensing probe 30 projecting coaxially down into the inlet chamber, thus serves as a plug which closes the upper end of the inlet chamber bore, as well as providing a constant display of the temperature of the hot melt in the inlet chamber.

The inlet fitting 11 is threaded into a short upper bore that opens from the inlet chamber to the rear face of the inlet chamber block 7. A similar bore, near the bottom of the block and coaxial with the screened passage 17, is normally closed by a plug 32 that can be removed for access to the filter screen 18.

The front leg portion 9 of the applicator body comprises a block 34 that defines the pump chamber, together with two superimposed plate-like members 35 and 36 that underlie the block 34 and cooperate with it and with one another to define the two valve chambers. The plate-like members 35 and 36 are secured to one another and to the block 34 by bolts 37 that extend upwardly through the plate-like members and are threaded into said block. In like manner the pump chamber block 34 can be secured to the inlet chamber block 7 by means of bolts (not shown) that extend through one of those blocks and are threaded into the other.

The pump chamber or cylinder 10 is defined by a vertical bore that extends all the way through the body block 34. At its upper end that bore opens to a shallow counterbore in which is confined an O-ring 38 that serves as a seal around the plunger 22.

The rear portion of the filter passage 17 is defined by a bore 40 and counterbore 41 in the upright block 7, opening to the front face thereof; and the front part of that passage is defined by a coaxial well 42 in the pump chamber block 34, opening to the rear face of that block but terminating short of the pump chamber 10. The counterbore 41 in the upright block 7 has the same diameter as the well 42 in the pump chamber block 42, which diameter is somewhat larger than that of the cylindrical filter screen 18. However, the screen closely fits in the axially short bore 40 in the block 7, which is near the inlet chamber 8, and therefore fluid is compelled to pass radially outwardly through the filter screen in flowing forwardly through the passage 17. An O-ring 43, confined in an axially shallow counterbore around the mouth of the well 42, serves as a gasket between the two blocks 7 and 34.

From the inner end of the well 42 in the pump chamber block 34 a small diameter bore 44 extends down to the bottom surface of that block to communicate the screened passage 17 with the inlet valve chamber 20. That chamber is defined by a counterbore at the mouth of said bore 44, and the inlet check valve 21 comprises a ball with a diameter larger than that of the bore 44 but small enough to be received in the counterbore with substantial clearance. The shoulder defined by the junction of bore 44 with counterbore 20 serves as a seat for the ball 21.

In the underside of the block 34 there is a shallow groove or elongated pocket 45, one end of which is at the inlet valve chamber and which is laterally spaced from the pump chamber bore 10. A leaf spring 46 is received in this pocket with a free end portion adjacent to the valve chamber and engaged under the ball 21 to urge the latter towards its seated position. The upper plate-like valve chamber member 35 has an L-shaped groove 47 in its upper surface, one leg 48 of which registers with the groove 45 in the block 34 to provide a spring chamber into which the leaf spring 46 can flex for unseating of the ball 21. The leg 48 of the L-shaped groove is shorter than its opposing groove 45 so that the captive or anchored end portion of the leaf spring 46 is confined in and clamped against the bottom of said groove 45 by the flat top surface of the plate-like member 35. The other leg 49 of the L-shaped groove extends over to the pump chamber 10 to provide an inlet thereto, at the bottom end thereof, that is controlled by the check valve 21.

From said other leg of the L-shaped groove 47, at its end remote from the spring chamber 48, an axially short bore 50 and a coaxial counterbore extend downwardly through the plate-like member 35, said counterbore defining the outlet valve chamber 26. The outlet check valve 27 is a ball similar to the inlet check valve 21 and is similarly urged upwardly towards its seated position by means of a leaf spring 51 having a captive or anchored end portion and a free end portion. The axially short bore 50 in the plate-like member 35 is coaxial with the pump chamber bore 10 and thus serves as an outlet from the pump chamber that is controlled by the outlet check valve.

The leaf spring 51 for the outlet check valve is received in an elongated shallow groove or pocket 52 in the bottom surface of the upper plate-like member 35. It is secured in place with its free end portion overlying a shorter registering groove 53 in the top surface of the lower plate-like member 36, by having its captive end portion clamped between the bottom of the groove or pocket 52 and the top surface of the lower plate-like member 36.

The outlet orifice 12 has a very small diameter, and is preferably defined by a small tube that is snugly fitted into the lower plate-like member and extends vertically through the same coaxially with the pump chamber 10 and the outlet valve chamber 26. The orifice 12 of course communicates with the spring chamber defined by the groove 53 in the top surface of the lower plate-like member 36.

At the conclusion of a discharge stroke of the plunger 22 the outlet orifice is effectively sealed at its inner end by closure of the outlet check valve 27 under the bias of its spring 51; hence, any hot melt that remains in the orifice will be trapped therein by the combined effects of atmospheric pressure at the lower end of the orifice and capillary action due to the small diameter of the orifice.

A retainer plate 55 flatwise overlies the top surface of the pump chamber block 34 and confines the O-ring seal 38 in its counterbore at the top of that block. The upper end portion of the plunger 22 projects above the retainer plate, through a hole therein that is concentric with the pump chamber 10, to have a link connection 56 with the piston 57 of the reciprocating pneumatic motor 25.

The cylinder of the motor 25 comprises a tubular member 60 in which the piston 57 has a close sliding fit, together with upper and lower end caps 61 and 62, respectively, which sealingly engage the opposite ends of the tubular member. Relatively long through-bolts 63 have their heads engaged with the top of the upper end cap 61 and extend downwardly, parallel to the cylinder axis, through the upper and lower end caps, through tubular spacer sleeves 64 and through the retainer plate 55, to have their lower end portions threaded into upwardly opening wells in the pump chamber block 34. The end caps 61 and 62 and the retainer plate 55 are all square in planform, and the holes for the through-bolts 63 are near their corners so that the through-bolts are in radially and circumferentially equispaced relation to one another and to the cylinder.

The spacer sleeves 64, which are interposed between the lower end cap 62 and the retainer plate 55, hold the cylinder of the pneumatic motor in upwardly spaced relation to the retainer plate, and they also enable the through-bolts to clamp the end caps against the ends of the tubular member 60 and to force the retainer plate flatwise down onto the top surface of the block 34. It will be evident that the sleeves 64, in holding the penumatic motor 25 spaced from the gun body, thermally insulate the motor and the gun body from one another so that air passing through the motor will not carry away heat from the body.

In each of the end caps 61, 62 there is an air passage 65 which leads to the interior of the cylinder and which comprises a fitting that is connectable with an air hose (not shown). It will be understood that the air passages 65 are alternately connected with a source of pressurized air, through an automatically and rapidly reversing valve mechanism of known type, so that pressure air is applied first to one side of the piston 57 and then to its other side, while air is exhausted from the end portion of the cylinder towards which the piston moves.

The piston has a coaxial stem 66 that projects down beneath the lower end cap 62 through a closely fitting bore therein in which there are O-rings 67 that provide a seal around the stem. The link 56 that connects the piston stem with the plunger 22 can be an ordinary transmission chain connecting link having its pins 68 passing through transverse holes in the piston stem and the plunger, respectively. The link of course constrains the plunger to partake of all axial motion of the piston while accommodating any misalignment between them. The employment of this link connection is made possible by the spacing between the gun body and the motor.

The stroke length of the piston determines the volumetric displacement of the pump that comprises the plunger 22, or, in other words, determines the amount of hot melt to be ejected with each discharging stroke of the plunger. To provide for adjustment of this quantity, an abutment screw 69 is threaded through the upper end cap, coaxially with the cylinder. Engagement of the piston against the lower end of this screw determines the upper limit of piston travel, hence downward adjustment of the screw 69 diminishess the volume of hot melt expelled at each ejection. The screw can be locked in any position of adjustment by means of a jam nut 70.

From the foregoing description taken with the accompanying drawings it will be apparent that this invention provides a thermoplastic hot melt applicator that dispenses small, discrete, accurately uniform quantities of hot melt; and it will also be apparent that the dot gun of this invention can dispense such uniform quantities of hot melt even though the viscosity of the hot melt may vary rather widely and the pressure on the hot melt at the source thereof is no more than sufficient to keep it flowing to the applicator.

Those skilled in the art will appreciate that the invention can be embodied in forms other than as herein disclosed for purposes of illustration.

The invention is defined by the following claims.

We claim:

1. A dispenser having a discharge orifice and by which molten thermoplastic fluid can be delivered from a source thereof to a zone of use in successive small, discrete, uniform quantities, said dispenser comprising:

A. body means;

B. means at an external surface of the body means providing the discharge orifice of the dispenser;

C. said body means having 1. a bore therein providing a pump cylinder with a mouth at one end thereof through which fluid enters and leaves the cylinder, 2. a cavity providing an inlet compartment having an entrance through which fluid enters from a source thereof and an exit through which fluid can leave the inlet compartment, 3. first passage means therein to communicate the exit of the inlet compartment with the mouth of the pump cylinder, and 4. second passage means to communicate the mouth of the pump cylinder with the discharge orifice, said first passage means comprising a. an inlet valve chamber communicated with the exit of the inlet compartment through the port of an inlet valve seat, b. a ball in said inlet valve chamber movable to and from engagement with said inlet valve seat, and c. an elongated leaf spring having an anchored end portion and a free end portion the latter of which projects into the inlet valve chamber and engages the ball therein to yieldingly hold the same on the inlet valve seat, said second passage means comprising a. an outlet valve chamber in open communication with the discharge orifice and communicated with the inlet valve chamber through the port of an outlet valve seat, b. a ball in said outlet valve chamber, and c. an elongated leaf spring having an anchored end portion and a free end portion the latter of which projects into the outlet valve chamber and engages the ball therein to yieldingly hold the same on the outlet valve seat, each of said leaf springs being flatwise normal to its associated valve seat so that the inlet and outlet valve chambers can have small volume and still accommodate flexing of the free end portions of the leaf springs therein;

D. a plunger reciprocable in the pump cylinder to draw fluid into the mouth of the cylinder during the charging stroke of the plunger and to expel fluid from the cylinder mouth during its discharging stroke, the orientation of said first and and second passage means and their respective valve seats being such that during the charging stroke of the plunger the ball in the outlet valve chamber is drawn tightly against its seat and the ball in the inlet valve chamber is drawn off its seat, enabling fluid to pass from the exit of the inlet compartment into the mouth of the pump cylinder, while during the discharge stroke of the plunger the disposition of the balls with respect to their respective seats is reversed, enabling fluid to be forced from the pump cylinder and out of the discharge orifice; and E. means for reciprocating the plunger.

2. A hot melt applicator for dispensing, in rapid succession, small discrete, uniform quantities of molten thermoplastic material, to enable a dotted line of such material to be formed on a workpiece surface, said applicator comprising:

A. a body consisting of superimposed secured together body elements defining 1. an elongated pump chamber having an inlet near one end thereof, and 2. an outlet passage extending substantially straight down from said end of the pump chamber through the lowermost of said superimposed body elements to the exterior of the body, the upper end portion of said outlet passage comprising an outlet valve chamber communicated with the pump chamber at said end thereof, said outlet valve chamber having relatively closely spaced top and bottom walls and said outlet passage having a small volume as a whole and having at its outlet end a cross section substantially smaller than that of the pump chamber so that capillary action and atmospheric pressure prevent any molten thermoplastic therein from escaping therefrom when the outlet passage is sealed at its upper end;

B. a plunger having a close sliding fit in the pump chamber;

C. plunger actuating means operatively connected with the plunger to impart charging and discharging strokes to the plunger to successively draw molten thermoplastic into said pump chamber through the inlet, and expel such thermoplastic from said chamber and through the outlet passage;

D. a ball valve element in said outlet valve chamber, said ball valve element being movable axially of the outlet passage between a closed position sealing the inner end portion of the outlet passage from communication with the pump chamber during the charging stroke of the plunger and an open position permitting flow of molten thermoplastic from the pump chamber through the outlet passage during the discharging stroke of the plunger;

E. biasing means urging the ball valve element towards its closed position, said biasing means comprising a thin flat leaf spring having a captive end portion and a free end portion;

F. coacting opposing surfaces on the lowermost and adjacent one of said superimposed body forming elements having the captive end portion of the leaf spring clamped therebetween to thereby secure the leaf spring in position with its free end portion extending into the outlet valve chamber and engaging said ball valve element and with the flat faces of its free end portion substantially parallel to and between said relatively closely spaced top and bottom walls of the outlet valve passage and normal to the axis of said outlet passage so that the outlet valve chamber can have a small volume but can nevertheless accommodate flexing of the free end portion of said leaf spring incident to opening and closing movement of said ball valve element.

3. The applicator of claim 2, further characterized by:

A. said body also defining an inlet chamber near the pump chamber and communicated with said inlet, for holding a supply of molten thermoplastic that can be drawn into the pump chamber, said inlet chamber being communicable with a source of molten thermoplastic under small pressure that is remote from the body; and B. heating means in the body, near said inlet chamber, for heating molten thermoplastic material therein to bring it up to a temperature at which it is to be dispensed.

4. The applicator of claim 3, wherein said heating means is further so located as to impart heat to substantially the entire body, and wherein the other end of the pump chamber opens to one face of the body and the plunger projects outside the body, beyond said face thereof, further characterized by:

A. a reciprocating air motor having a driving connection with the plunger to reciprocate the same; and B. means mounting the air motor on the body in spaced relation to said face of the body, to thermally insulate the air motor from the body.

5. The applicator of claim 2, wherein said body further defines an inlet valve chamber with relatively closely spaced top and bottom walls adjacent to the pump chamber and communicated therewith through said inlet, and further characterized by:

A. a second ball valve element in said inlet valve chamber movable in opposite directions between a closed position preventing flow of molten thermoplastic into the pump chamber and an open position permitting such flow;

B. means biasing said second ball valve element towards its closed position, the last named means comprising a second leaf spring in the form of a thin, flat strip of metal having a captive end portion and a free end portion; and C. coacting opposing surfaces on two adjacent body forming elements having the captive end portion of said second leaf spring clamped therebetween to thereby secure the second leaf spring in position with its free end portion extending into said inlet valve chamber and engaging said second ball valve element and with the opposite faces of its free end portion substantially parallel to and between the relatively closely spaced top and bottom walls of the inlet valve passage and normal to the directions of movement of the second ball valve element so that the inlet valve chamber can have a small volume to insure accurate metering of the quantity of molten thermoplastic drawn into the pump chamber and discharged therefrom during each cycle of plunger reciprocation.

6. An applicator by which molten thermoplastic adhesive from a source thereof at low pressure can be dispensed in rapidly successive small, discrete, uniform quantities, said applicator comprising:

A. body means having a substantially flat bottom face and having therein 1. a bore opening to said bottom face and providing a pump chamber, 2. an inlet chamber communicable with the pump chamber and in which a small supply of molten adhesive can be retained, there being an inlet through another face of the body means by which said inlet chamber can be connected with a remote source of molten adhesive under low pressure, and 3. passage means leading from the inlet chamber to said bottom face, said passage means terminating in a counterbore which opens to said bottom face in spaced relation to the pump chamber and which provides an inlet valve chamber, and 4. said body means having in its said bottom face an elongated leaf spring groove which extends lengthwise in one direction from said counterbore and which is laterally spaced from said pump chamber;

B. a closely fitting plunger reciprocable in the pump chamber;

C. plunger actuating means operatively connected with the plunger to reciprocate the same successively in a first direction to draw molten adhesive from the inlet chamber into the pump chamber and in the opposite direction to expel molten adhesive from the pump chamber;

D. a first ball check valve element in said inlet valve chamber movable to and from a closed position preventing flow of molten adhesive from the inlet valve chamber towards the inlet chamber;

E. a first flat, elongated leaf spring located in said groove and having a free end portion engaged with the first valve element, for biasing the same towards its closed position;

F. an upper plate-like member secured in flatwise underlying relationship to said bottom face of the body means, said upper plate-like member having substantially flat top and bottom faces and 1. having a small diameter bore coaxial with the pump chamber and a coaxial counterbore opening to its bottom face that provides an outlet valve chamber, 2. having in its upper face a substantially L-shaped groove that communicates the inlet valve chamber with the pump chamber, one leg of said groove terminating at the pump chamber and the last-mentioned bore, the other leg thereof being in register with a part of said groove in the body means, to provide a spring chamber in which said one end portion of the first leaf spring is flatwise movably received, the other end portion of said leaf spring being confined in said spring chamber by the flat upper surface of the upper member, and 3 having in its lower face a shallow, elongated groove that extends lengthwise from said counterbore in the upper plate-like member;

G. a second ball check valve element in said counterbore that is in the upper plate-like member, movable between a closed position blocking flow of molten thermoplastic upwardly into the pump chamber and an open position permitting flow downwardly out of the pump chamber;

H. a second elongated, flat leaf spring, located in said groove in the bottom surface of the upper plate-like member and having a free end portion engageable with said second valve element for biasing the same towards its closed position; and I. a lower plate-like member having a substantially flat top surface and secured in flatwise underlying relation to the upper plate-like member, said lower plate-like member 1. having a small diameter outlet passage therethrough that is coaxial with the pump chamber, and 2 having in its upper surface an elongated shallow groove to which said outlet passage opens and which registers with said groove in the lower face of the upper plate-like member to provide a spring chamber in which said one end portion of the second leaf spring is movably received, the other end portion of said second leaf spring being held in place by the flat upper surface of the lower plate-like member.

7. The applicator of claim 6, wherein said body means has a substantially flat top face opposite said bottom face, and wherein said plunger projects beyond the top face, further characterized by:

I. a reciprocating pneumatic motor comprising a cylinder and a piston;

J. means securing said pneumatic motor to the body means in spaced relation to the top face thereof and in coaxial relation to the pump chamber; and K. a link connecting the projecting end portion of the plunger with the piston of the pneumatic motor, said link being accommodated in the space between the body means and the pneumatic motor.

8. The applicator of claim 7, further characterized by:

means on the cylinder providing an adjustable stop engageable by the piston to define the limit of its reciprocating motion in one direction, adjustment of said means providing for control of the quantity of fluid expelled by the plunger at each reciprocation thereof.

9. A dispenser having a discharge orifice and by which molten thermoplastic fluid can be delivered from a source thereof to a zone of use in successive small, discrete, uniform quantities, said dispenser comprising:

A. a body having 1. opposite faces,
2. a bore having one of its ends opening to one of said opposite faces, said bore providing a pump cylinder with a mouth defined by said end of the bore, and
3. an inlet compartment having
   a. an entrance through which molten thermoplastic fluid enters the dispenser from a source thereof, and
   b. an exit opening to said face of the body at a point spaced from but adjacent to the mouth of the pump cylinder;

B. a plunger reciprocable in the pump cylinder to draw fluid into the cylinder from the inlet compartment during its charging stroke and to expel fluid from the cylinder during its discharing stroke;

C. a passage-forming assembly secured to said face of the body to coact with the plunger in delivering fluid to the pump cylinder and discharging the same through the discharge orifice of the dispenser, said assembly comprising 1. a pair of inner and outer overlying plates, the former being contiguous to said face of the body,
2. means on the outer plate providing the discharge orifice of the dispenser,
3. means at the interface of said inner plate and said face of the body defining
   a. an inlet valve chamber in open communication with the mouth of the pump cylinder and with the exit of said inlet compartment, and
   b. an inlet valve seat with a port therethrough, and an outlet valve seat with a port therethrough, the former being between the exit of the inlet compartment and the inlet valve chamber, and the latter providing an exit from said inlet valve chamber,
4. means at the interface between said inner and other plates defining an outlet valve chamber that has open communication with the discharge orifice and that communicates with the inlet valve chamber through the port of said outlet valve seat,
5. a ball in each of said valve chambers, and
6. first and second leaf springs, each having an anchored end portion and a free end portion, the first leaf spring having its anchored end portion clamped between the inner plate and said face of the body with its free end portion projecting into the inlet valve chamber and engaging the ball therein, to yieldingly hold the same on its respective seat, and the second leaf spring having its anchored end portion clamped between the inner and outer plates with its free end portion extending into the outlet valve chamber and engaging the ball therein, to yieldingly hold the same on its respective seat, the orientation of the inlet and outlet valve chambers and their respective valve seats being such that during the charging stroke of the plunger the ball in the outlet valve chamber is drawn onto its seat enabling fluid to be drawn into the pump cylinder, while during the discharging stroke the disposition of the balls with respect to their seats is reversed enabling fluid to be forced from the pump cylinder and out of the discharge orifice; and D. means for reciprocating the plunger.

10. The dispenser of claim 9, wherein said means for reciprocating the plunger comprises a pneumatic motor, and further characterized by:

A. a heating element in said body to heat the same and assure that fluid flowing therethrough will be at a high enough temperature for dispensing;

B. means rigidly mounting said pneumatic motor on the body at the face thereof that is opposite said face at which said passage-forming assembly is located but in spaced relation to the body, so that the pneumatic motor is thermally insulated from the body; and C. means forming a motion transmitting connection between the pneumatic motor and the plunger.

11. The dispenser of claim 10, further characterized in that said leaf springs are flatwise normal to the axes of their associated valve seats, so that the valve chambers into which their free end portions project can have a small volume and still accommodate flexing of the free end portions of the leaf springs.

* * * * *